US010376070B1

(12) United States Patent
Jen

(10) Patent No.: US 10,376,070 B1
(45) Date of Patent: Aug. 13, 2019

(54) ROTATABLE SEAT FOR PREVENTING FALLING BACKWARDS

(71) Applicant: TECVIEW GROUP CO., LTD., Taoyuan (TW)

(72) Inventor: Li-Wen Jen, Taoyuan (TW)

(73) Assignee: TECVIEW GROUP CO., LTD., Taoyuan (TW)

( * ) Notice: Subject to any disclaimer, the term of this patent is extended or adjusted under 35 U.S.C. 154(b) by 0 days.

(21) Appl. No.: 15/948,324

(22) Filed: Apr. 9, 2018

(51) Int. Cl.

| | |
|---|---|
| ***A47C 9/00*** | (2006.01) |
| ***A47C 3/18*** | (2006.01) |
| ***A63B 22/18*** | (2006.01) |
| ***A63B 26/00*** | (2006.01) |

(52) U.S. Cl.
CPC ..... *A47C 9/002* (2013.01); *A47C 3/18* (2013.01); *A63B 22/18* (2013.01); *A63B 26/003* (2013.01)

(58) Field of Classification Search
CPC ..... A47C 9/002; A47C 3/18; A47C 3/185; A47C 31/003; A63B 22/18; A63B 26/003
See application file for complete search history.

(56) References Cited

U.S. PATENT DOCUMENTS 478,166 A * 7/1892 Madsen ..... A63B 23/08 482/146
3,863,982 A * 2/1975 Sandham ..... A47C 3/026 248/596
6,481,795 B1 * 11/2002 Pettibon ..... A47C 3/02 297/195.11
6,709,052 B2 * 3/2004 Jalkanen ..... A47C 9/025 297/202
7,175,577 B2 * 2/2007 Greenspan ..... A61H 1/0237 482/146
7,374,517 B2 * 5/2008 Lockett ..... A63B 21/0004 297/271.5
7,632,218 B2 * 12/2009 Sannes ..... A63B 22/18 482/146
7,931,565 B2 * 4/2011 Nakano ..... A63B 69/04 434/247
9,788,659 B1 * 10/2017 Jen ..... A47C 9/002
2005/0029842 A1 * 2/2005 Martin ..... B62J 1/02 297/199

(Continued)

FOREIGN PATENT DOCUMENTS

DE 202016101986 U1 4/2016

*Primary Examiner* — Timothy J Brindley
(74) *Attorney, Agent, or Firm* — Muncy, Geissler, Olds & Lowe, P.C.

(57) ABSTRACT

A rotatable seat for preventing falling backwards is revealed. The rotatable seat includes a seat member, a base member and a safety member for preventing users from falling backwards. Users can work out by keeping their bodies balanced or shaking their buttocks, like horseback riding while sitting on a saddle-shaped surface of the seat member. Before the users sitting on the seat member, a pommel portion of the seat member is inclined forwards, attached to and positioned on at least one support portion of the base member, unable to be moved freely due to attraction between at least one first magnet and at least one second magnet of the safety member for preventing users from falling backwards. Thus the user's backside can cross over the pommel portion easily to sit on the seat member more safely while using the rotatable seat.

9 Claims, 9 Drawing Sheets

(56) References Cited

U.S. PATENT DOCUMENTS

| | | | | |
|---|---|---|---|---|
| 2007/0027009 | A1* | 2/2007 | Arnold | A63B 21/005 482/146 |
| 2007/0138850 | A1* | 6/2007 | Oettinger | A47C 3/029 297/271.5 |
| 2007/0298395 | A1* | 12/2007 | Nakanishi | A63B 69/04 434/258 |
| 2007/0298947 | A1* | 12/2007 | Eksteen | A63B 21/0004 482/141 |
| 2008/0009395 | A1* | 1/2008 | Tseng | A63B 69/04 482/51 |
| 2008/0207410 | A1* | 8/2008 | Tacconi | A63B 22/18 482/123 |
| 2009/0062090 | A1* | 3/2009 | Nakanishi | A63B 26/003 482/136 |
| 2011/0012397 | A1* | 1/2011 | Wallace | A47C 7/029 297/195.11 |
| 2011/0028290 | A1* | 2/2011 | Ozawa | A63B 21/0085 482/142 |
| 2013/0334846 | A1* | 12/2013 | Bahneman | A47C 9/00 297/195.11 |
| 2015/0305961 | A1* | 10/2015 | Broerman | A47C 9/002 601/115 |
| 2016/0320862 | A1* | 11/2016 | Schradin | A63F 13/00 |
| 2017/0079441 | A1* | 3/2017 | Murray | A47C 9/002 |
| 2017/0112287 | A1* | 4/2017 | Schmitz | A47C 7/029 |
| 2017/0291069 | A1* | 10/2017 | Zakariasen | A63B 26/003 |
| 2018/0304121 | A1* | 10/2018 | Osler | A47C 9/002 |
| 2019/0104851 | A1* | 4/2019 | Carey | A47C 7/021 |

* cited by examiner

ROTATABLE SEAT FOR PREVENTING FALLING BACKWARDS

BACKGROUND OF THE INVENTION

The present invention relates to a rotatable seat, especially to a rotatable seat for preventing falling backwards, which is placed on a seat of a chair or on a flat surface for users to shake their backsides and work out while sitting thereon without falling backwards.

Refer to U.S. Pat. No. 9,788,659 B1, DE 20 2016 101 986, etc., these are prior arts in the field related to rotatable seats/chairs. However the rotatable seat available now is not provided with any safety member for preventing users from falling backwards. When users intend to sit/ride on a seat member of a conventional rotatable seat, the users' legs are wide apart and standing on the ground to keep balance (as the posture shown in FIG. 17). Then the user's center of gravity naturally starts to move backwards until the user's buttocks are mounted in the seat member completely (as the posture shown in FIG. 18) when the user's buttocks are in contact with the seat member. The seat member of the conventional rotatable seat is unbalanced so that it is rotated freely until a stop is reached (as the seat member 10 represented by the dashed line in FIG. 17). Thus the user is easy to rotate along with the seat member and fall backwards during the sitting (as the arrow D and the arrow E in FIG. 18 indicate). There is a risk of injury to the users. Thus there is room for improvement and there is a need to provide a novel rotatable seat.

SUMMARY OF THE INVENTION

Therefore it is a primary object of the present invention to provide a rotatable seat for preventing falling backwards in which a magnetic safety member for preventing users from falling backwards is arranged between a seat member and a base member. A pommel portion of the seat member is inclined forwards, attached to and positioned on at least one support portion of the base member while a user is going to sit on the seat member. Thus users will not fall backwards easily while sitting on the rotatable seat.

In order to achieve the above object, a rotatable seat for preventing falling backwards according to the present invention includes a seat member, a base member and a safety member for preventing users from falling backwards. The seat member further includes a saddle-shaped surface that is used for allowing users to sit thereon and composed of a pommel portion, a seat portion and a cantle portion arranged in turn from front to back. A spherical surface portion is projecting from a bottom surface of the saddle-shaped surface while the base member is disposed under the seat member and at least one support portion is arranged at a top surface of the base member. The spherical surface portion of the seat member is moveably set on the support portion so that the seat member can be rotated at different angles or wobbled freely in different directions relative to the base member. The safety member for preventing users from falling backwards consists of at least one first magnet and at least one second magnet, attracted to each other. The first magnet is set on a front part of the spherical surface portion of the seat member, close to the pommel portion while the second magnet is mounted in the support portion of the base member. Thereby users can work out and get fit by keeping their bodies balanced or shaking their buttocks, like horseback riding while sitting on the saddle-shaped surface of the seat member. Before the user sits on the seat member of the rotatable seat, the pommel portion of the seat member is inclined forwards, attached to and positioned on the support portion of the base member, unable to be moved freely due to attraction between the first magnet and the second magnet of the safety member for preventing users from falling backwards. Thus the user's backside can cross over the pommel portion easily to sit on the seat member more safely while using the rotatable seat.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein:

FIG. 12 is an explosive view of the embodiment in FIG. 11 according to

DETAILED DESCRIPTION OF THE PREFERRED EMBODIMENT

Figure 1:
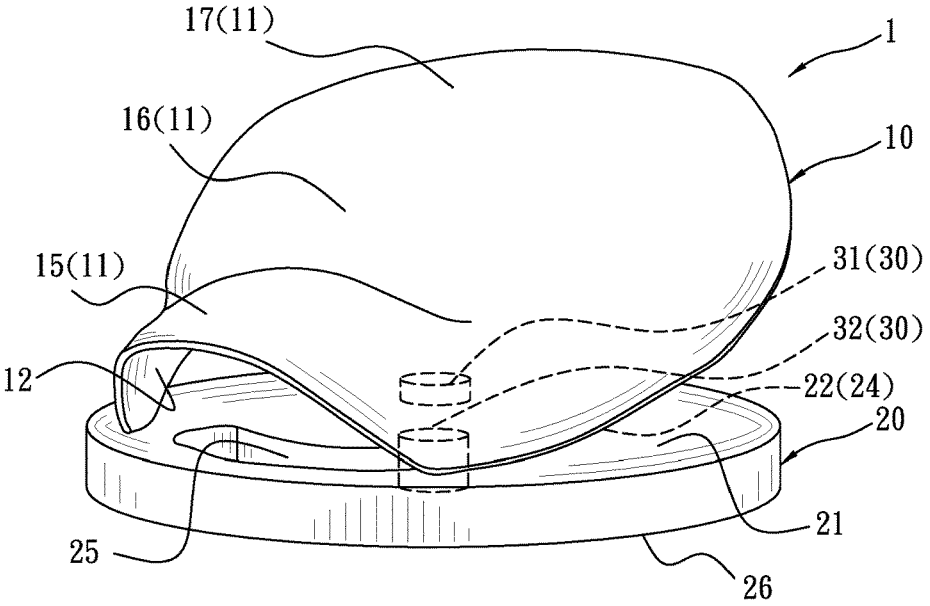
FIG. 1 is a perspective view of an embodiment according to the present invention.

Refer to FIG. 1, a rotatable seat for preventing falling backwards 1 according to the present invention includes a seat member 10, a base member 20 and a safety member for preventing users from falling backwards 30.

Figure 2:
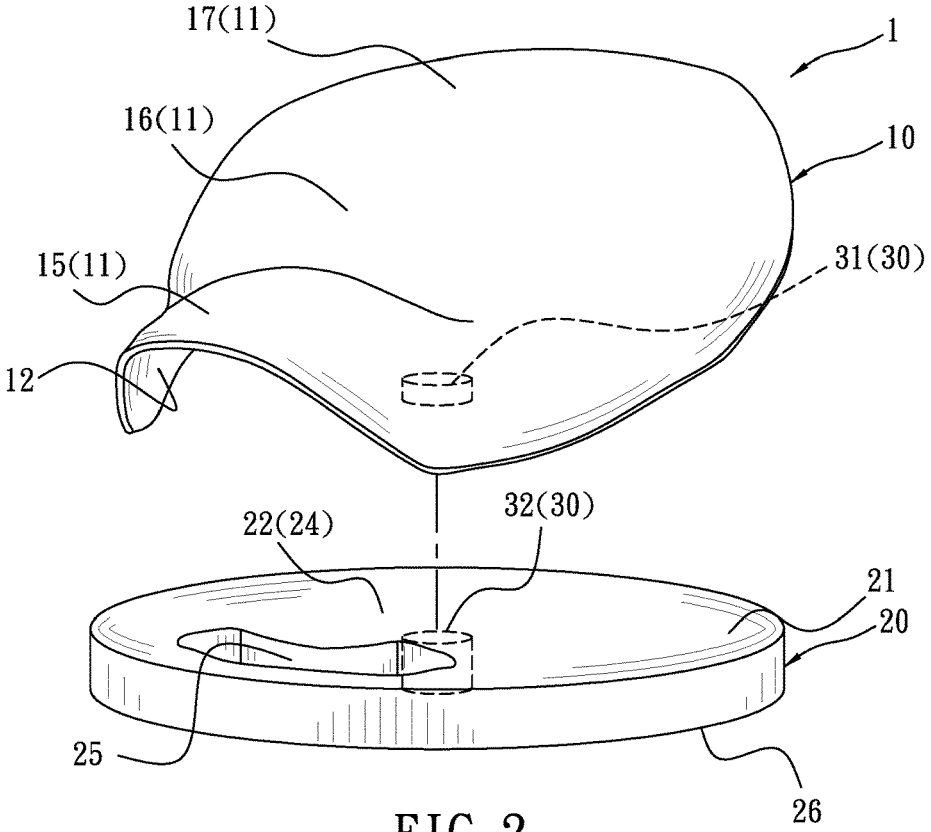
FIG. 2 is an explosive view of the embodiment in FIG. 1 according to the present invention.
Figure 3:
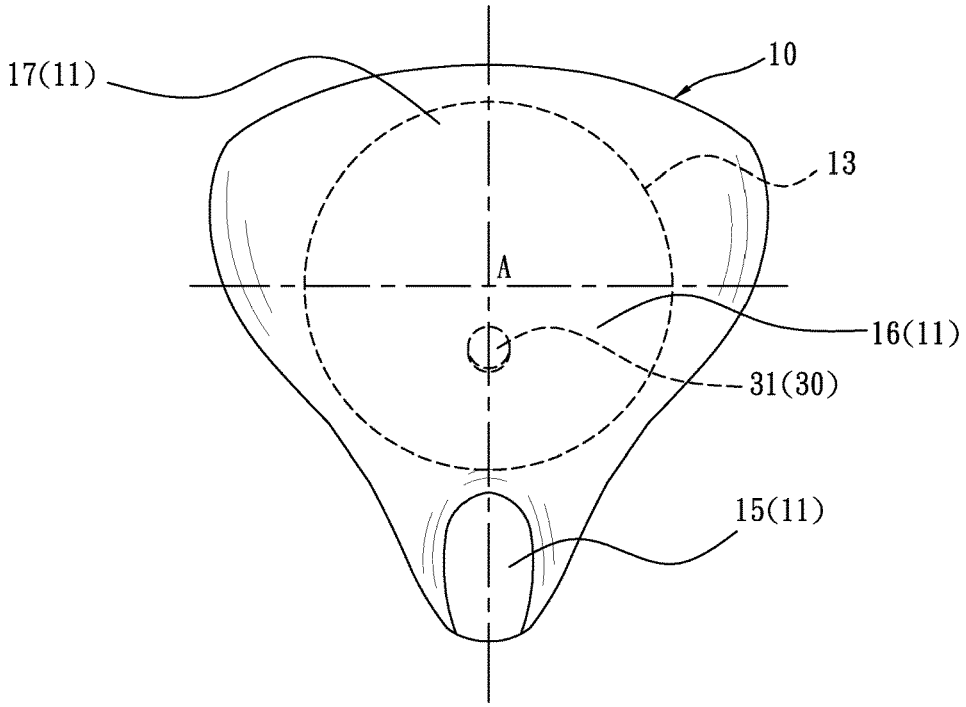
FIG. 3 is a schematic drawing showing a top view of a seat member of the embodiment in FIG. 2 according to the present invention.
Figure 5:
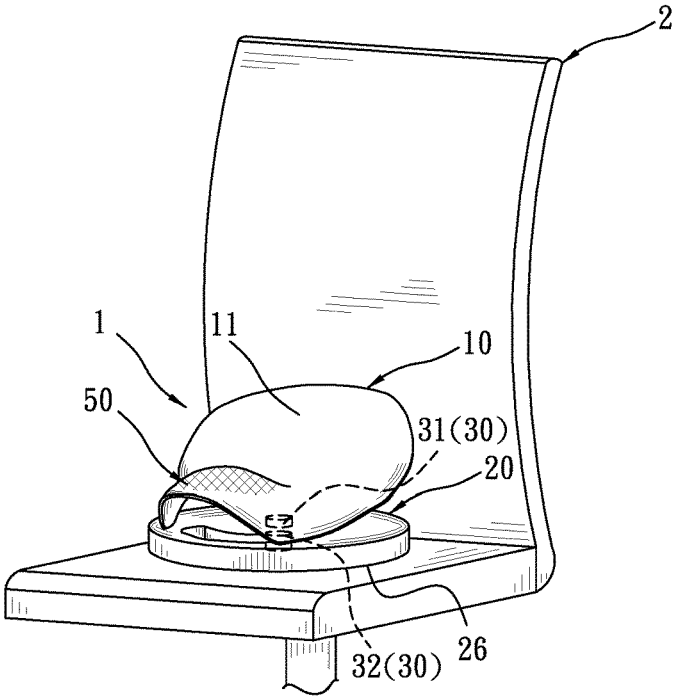
FIG. 5 is a schematic drawing showing the embodiment in FIG. 1 in use according to the present invention.
Figure 6:
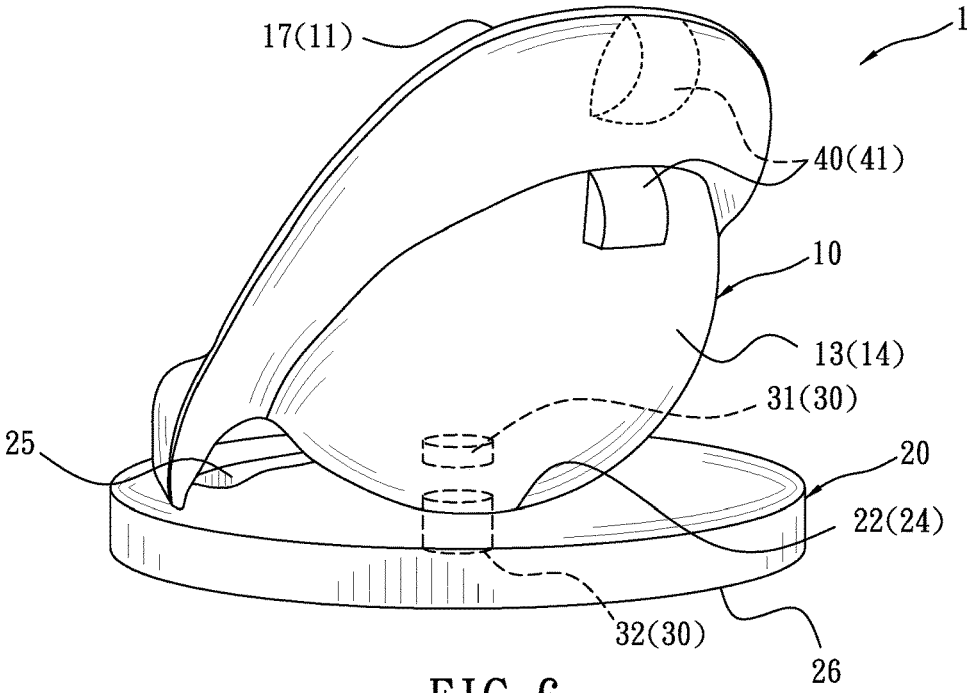
FIG. 6 is a perspective view of the embodiment in FIG. 1 with a stopping member for preventing falling backwards viewed from a different angle according to the present invention.
Figure 13:
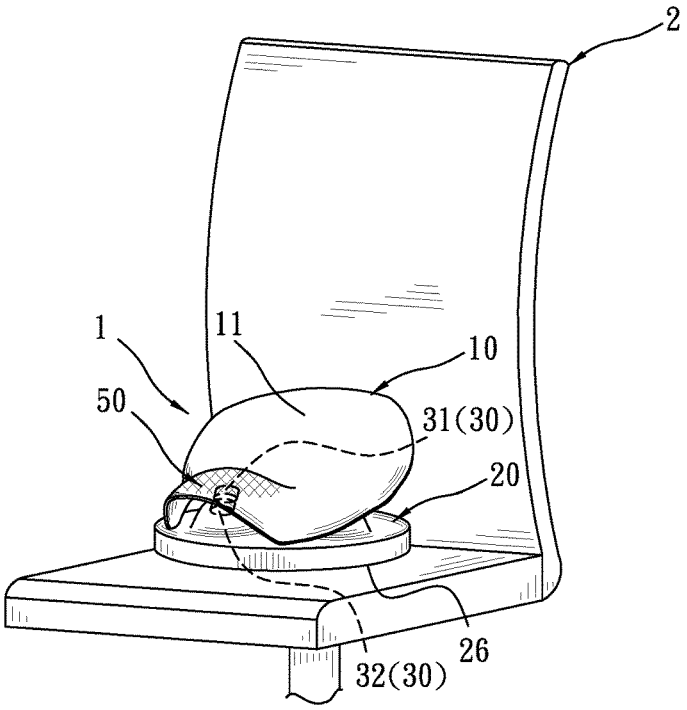
FIG. 13 is a schematic drawing showing the embodiment in FIG. 11 in use according to the present invention.
Figure 14:
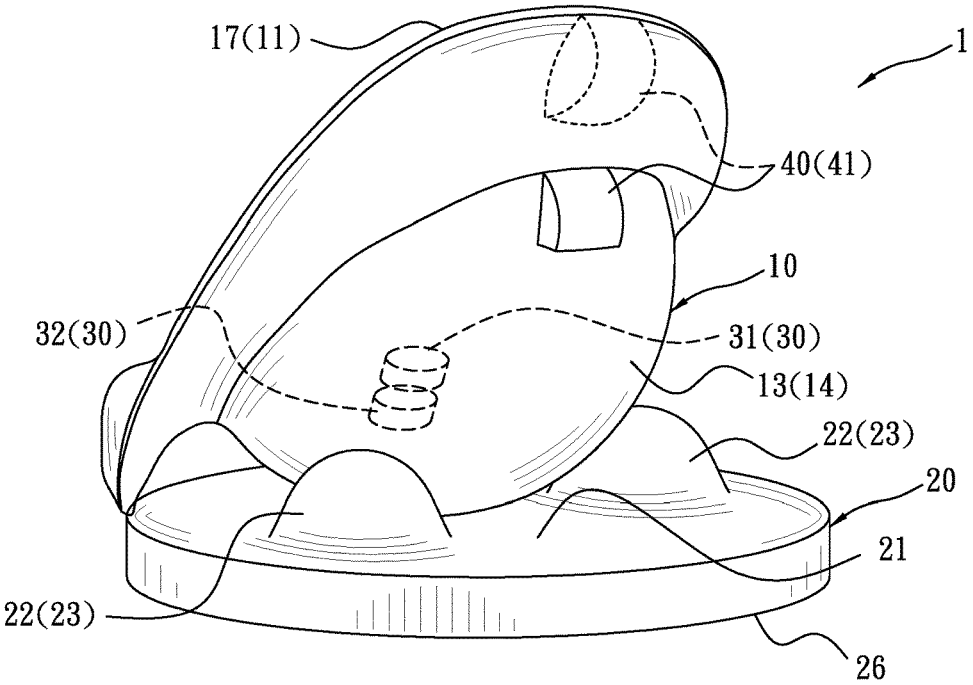
FIG. 14 is a perspective view of the embodiment in FIG. 11 with a stopping member for preventing falling backwards viewed from a different angle according to the present invention.

Refer to FIG. 2 and FIG. 3, the seat member 10 consists of a saddle-shaped surface 11, and a spherical surface portion 13 projecting from a bottom surface 12 of the saddle-shaped surface 11. The saddle-shaped surface 11 allows users to sit thereon. A pommel portion 15, a seat portion 16 and a cantle portion 17 are arranged at the saddle-shaped surface 11 in turn from front to back. As shown in FIG. 6 and FIG. 14, the spherical surface portion 13 is a hemisphere 14. Refer to FIG. 5 and FIG. 13, a soft part 50 such as padding or leather cover is further covered on the saddle-shaped surface 11 of the seat member 10 to make users more comfortable while sitting on the seat member 10.

The base member 20 is disposed under the seat member 10. As shown in FIG. 1 and FIG. 2, the base member 20 is composed of a top surface 21, at least one support portion 22, and a bottom surface 26. The spherical surface portion 13 of the seat member 10 is moveably disposed on the support portion 22 of the base member 20. Thus the seat member 10 can be rotated at different angles or wobbled freely in different directions relative to the base member 20 due to the spherical surface portion 13 being supported by the support portion 22. Moreover, the bottom surface 26 of the base member 20 can be a flat surface, able to be placed on a seat of a chair 2 as shown in FIG. 5 and FIG. 13 or on a flat and smooth place. Thereby the rotatable seat 1 is easier and more convenient to use.

Figure 8:
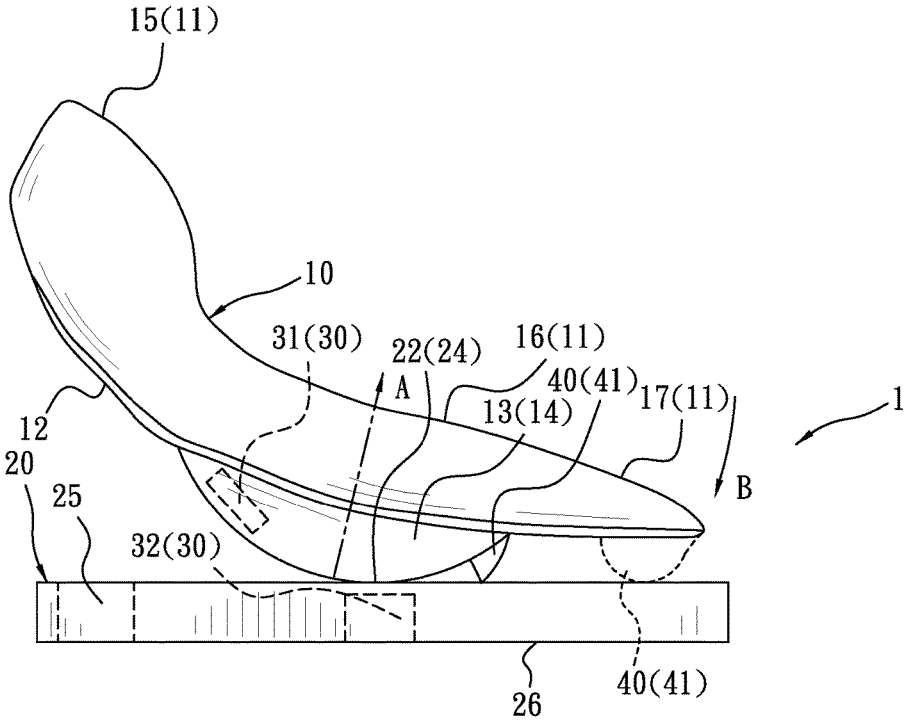
FIG. 8 is a side view of the embodiment shown in FIG. 7 in movement according to the present invention.
Figure 9:
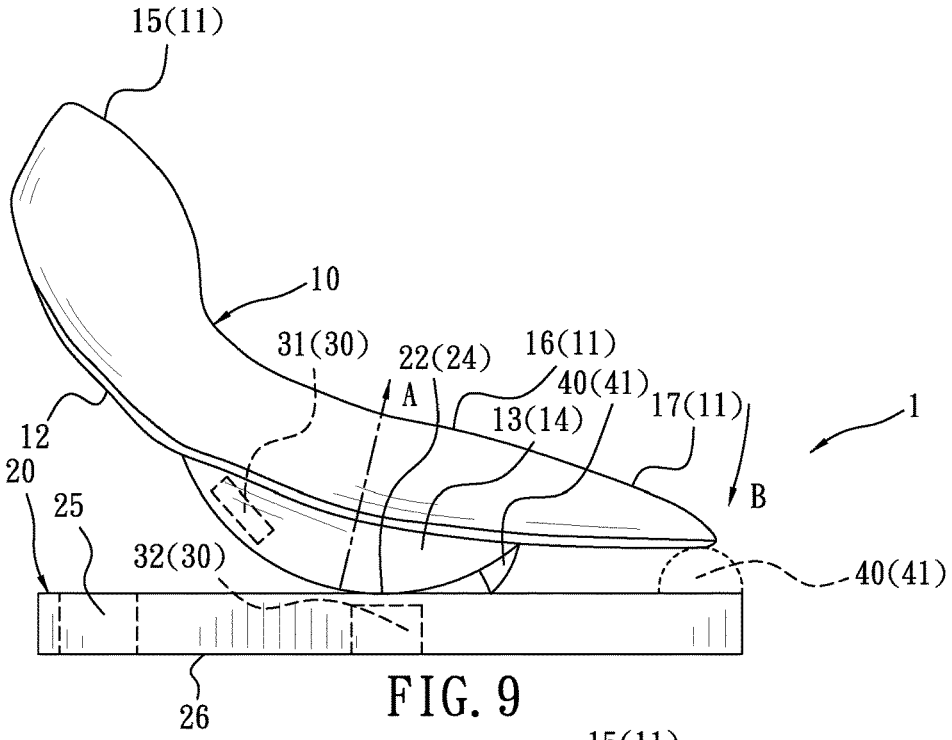
FIG. 9 is a side view of the embodiment in FIG. 7 with another stopping member for preventing falling backwards according to the present invention.

Owing to the spherical surface portion 13 being supported by the support portion 22 of the base member 20, the seat member 10 on the support portion 22 of the base member 20 can be rotated at different angles (ranging from 0 to 360 degrees) or moved in different directions such as forwards, backwards and sideways (left/right). Take an embodiment shown in FIG. 7-9, FIG. 15 and FIG. 16 as an example. An axis A of the spherical surface portion 13 can be moved freely from the direction inclined forward relative to the base member 20 (the pommel portion 15 of the seat member 10 is close to the base member 20) shown in FIG. 7 and FIG. 15 to a certain direction such as the direction the arrow B in FIG. 8, FIG. 9, and FIG. 16 indicated with respect to the seat member 10. There is no restriction on the direction, the angle or the magnitude of the seat member 10 being wobbled. Thus the axis A of the spherical surface portion 13 is inclined backwards with respect to the base member 20 (now the cantle portion 17 of the seat member 10 is close to the base member 20), as shown in FIG. 8, FIG. 9 and FIG. 16. The direction the arrow B in FIG. 8, FIG. 9 and FIG. 16 indicated with respect to the seat member 10 is only one of the directions around the axis A of the spherical surface portion 13 to which the seat member 10 can be moved. Thus users' bottom can wobble in one of the directions around them such as forwards, backwards, or sideways and the wobbling magnitude can be controlled by the user as long as the seat member 10 is not separated from the support portion 22 of the base member 20.

Thereby users can move freely at different angles or in different directions such as forwards, backwards, and sideways by the connection between the spherical surface portion 13 and the support portion 22 while sitting on the saddle-shaped surface 11 of the seat member 10. The users can work out and get fit by keeping their bodies balanced or shaking their buttocks on the rotatable seat since the movement on the rotatable seat 1 simulates horseback riding.

The safety member for preventing users from falling backwards 30 includes at least one first magnet 31 and at least one second magnet 32, attracted to each other. The first magnet 31 is set on a front part of the spherical surface portion 13 of the seat member 10, close to the pommel portion 15 while the second magnet 32 is mounted in the support portion 22 of the base member 20.

Figure 7:
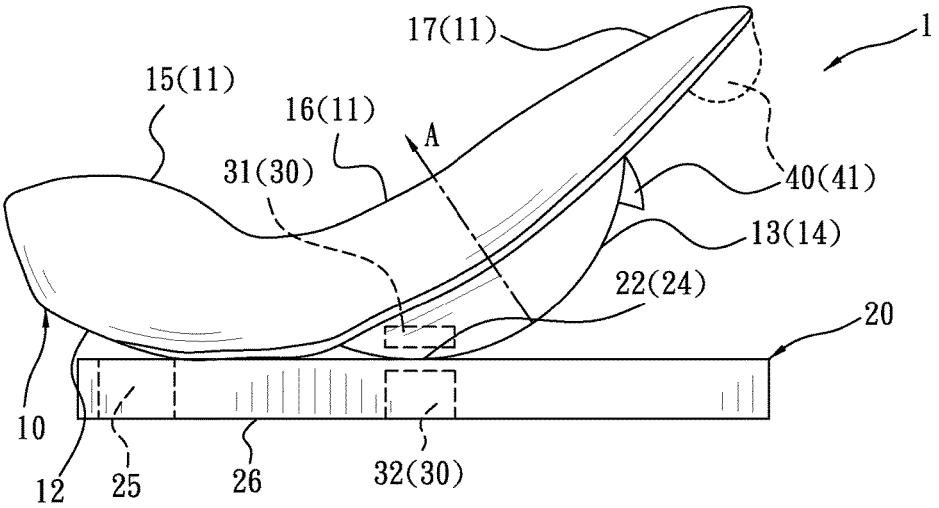
FIG. 7 is a side view of the embodiment shown in FIG. 6 according to the present invention.
Figure 17:
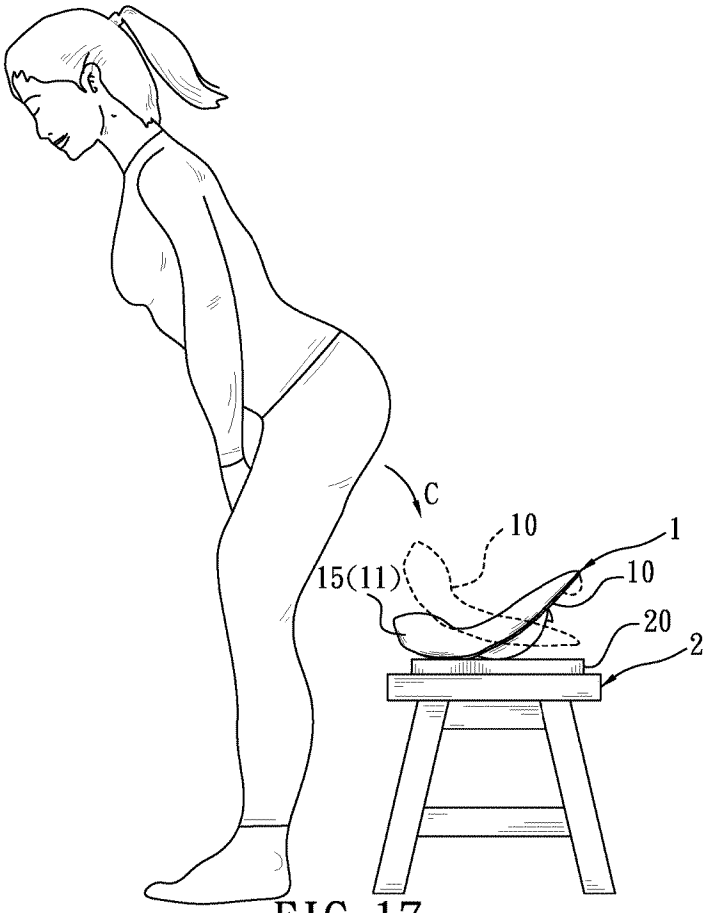
FIG. 17 is a schematic drawing showing a side view of an embodiment before a user sitting thereon according to the present invention.

As shown in FIG. 17, before the user sits on the seat member 10 of the rotatable seat 1, the pommel portion 15 of the seat member 10 is inclined forwards, attached to and positioned on the support portion 22 of the base member 20, unable to be moved freely (as shown in FIG. 5-7) due to attraction between the first magnet 31 and the second magnet 32 of the safety member for preventing users from falling backwards 30. Thus the user's backside can move backwards and cross over the pommel portion 15 easily to sit on the seat portion 16 of the seat member 10 more safely while sitting on the rotatable seat 1.

Figure 4:
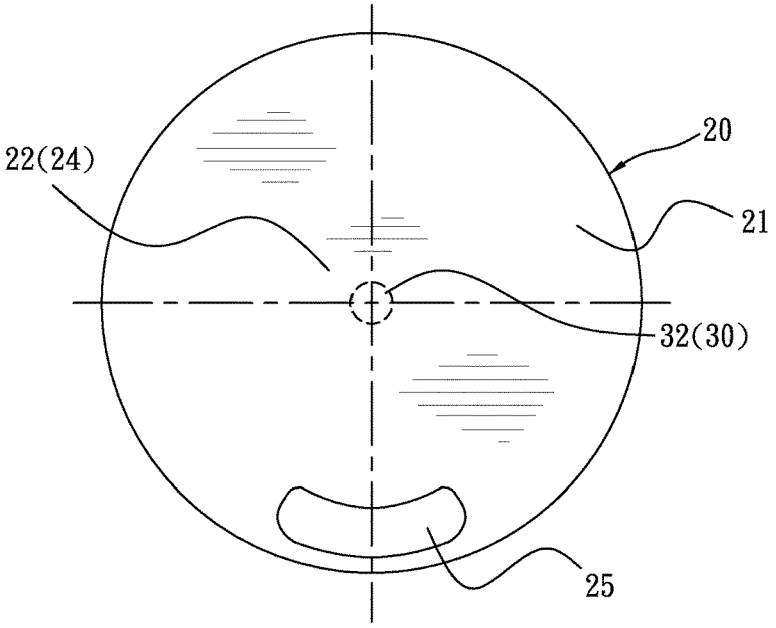
FIG. 4 is a schematic drawing showing a top view of a base member of the embodiment in FIG. 2 according to the present invention.

Refer to FIG. 1-10, a flat surface 24 is formed on the top surface 21 of the base member 20 and used as the support portion 22. In this embodiment, the first magnet 31 is arranged at the front part of the spherical surface portion 13, close to the pommel portion 15 while the second magnet 32 is mounted in the center (A) of the flat surface 24, as shown in FIG. 4. Thereby the pommel portion 15 of the seat member 10 is inclined forwards, attached to and positioned on the center (A) due to attraction between the first magnet 31 and the second magnet 32 in the center (A) of the flat surface 24. Thereby the seat member 10 is positioned, without sliding or even separated from the base member 20 while users are wobbling on the rotatable seat 1. The rotatable seat 1 is used more efficiently.

The base member 20 is made from, but not limited to, polyethylene (PE). The certain area of the flat surface 24 in contact with the spherical surface portion 13 of the seat member 10 is a bit hollow while the spherical surface portion 13 (hemisphere 14) of the seat member 10 is against the flat surface 24. A proper friction/smoothness is generated between the spherical surface portion 13 (hemisphere 14) and the flat surface 24 due to the PE. Thus the seat member 10 is still positioned on the center (A) of the flat surface 24, without sliding or even separated from the base member 20 while being moved in different directions. In this embodiment, the seat member 10 is getting difficult or unable to be positioned on the center (A) of the flat surface 24 while being wobbled in various directions once the base member 20 is made from rigid metal or wood, or the flat surface 24 is very smooth (having quite smaller friction). Thus the seat member 10 is easily sliding or falling off from the base member 20 and this cause trouble or harm to users while in use.

Figure 10:
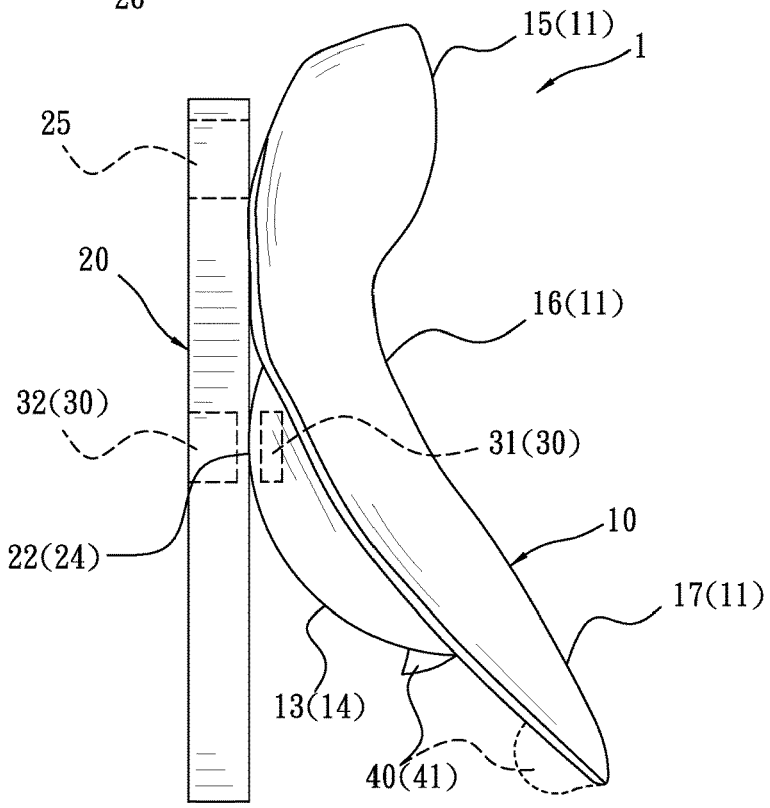
FIG. 10 is a side view of the embodiment in FIG. 7 standing upright for being held by users according to the present invention.

Refer to FIG. 4 and FIG. 10, a grasp portion 25 is disposed on the base member 20, close to the edge of the base member 20. The grasp portion 25 is a slot penetrating the base member 25. Thereby the user can carry the rotatable seat 1 with them by hands while the seat member 10 and the base member 20 being connected by the magnetic force, as shown in FIG. 10.

Refer to FIG. 11-16, another embodiment is revealed. In this embodiment, there are three spherical bumps 23 on the top surface 21 of the base member 20 used as the support portions 22. The three spherical bumps 23 are projecting from the top surface 21 of the base member 20, having the same height and arranged at the top surface 21 in a regular triangle manner. Thereby the spherical surface portion 13 (hemisphere 14) of the seat member 10 can be supported by and moved stably among the three spherical bumps 23.

Figure 11:
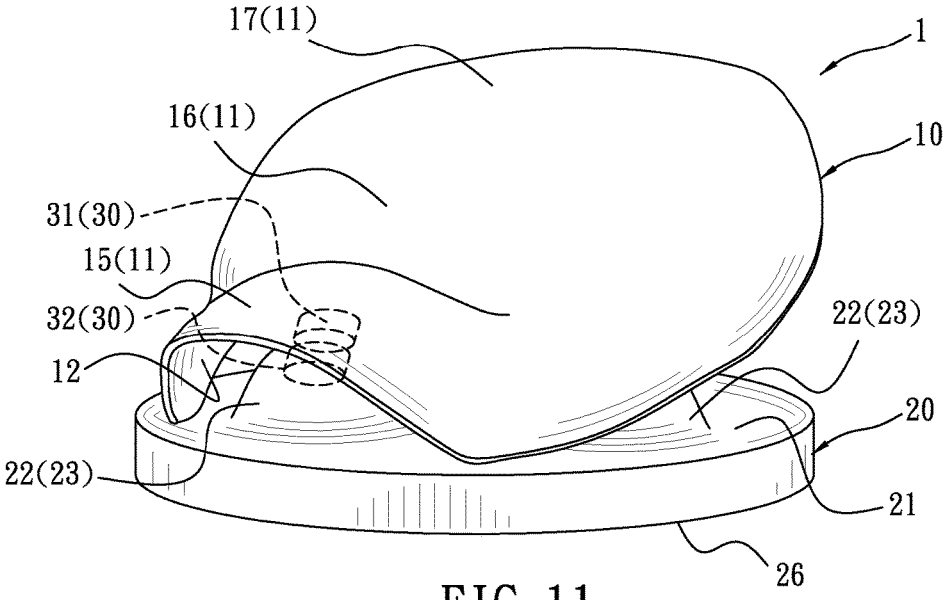
FIG. 11 is a perspective view of an embodiment according to the present invention.
Figure 12:
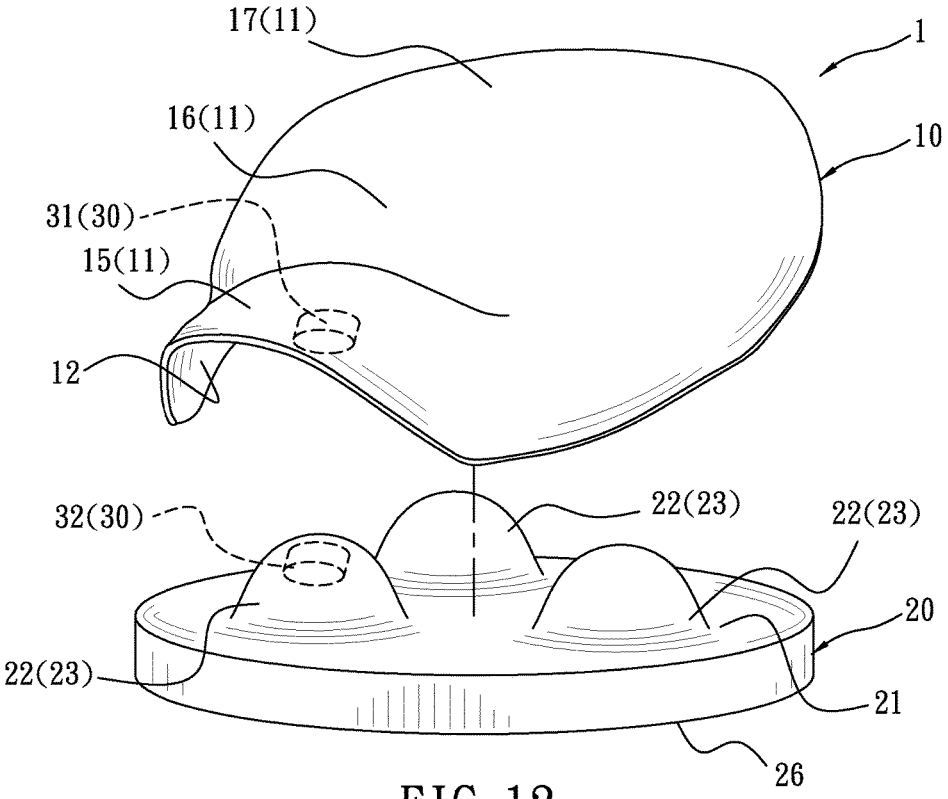
Figure 15:
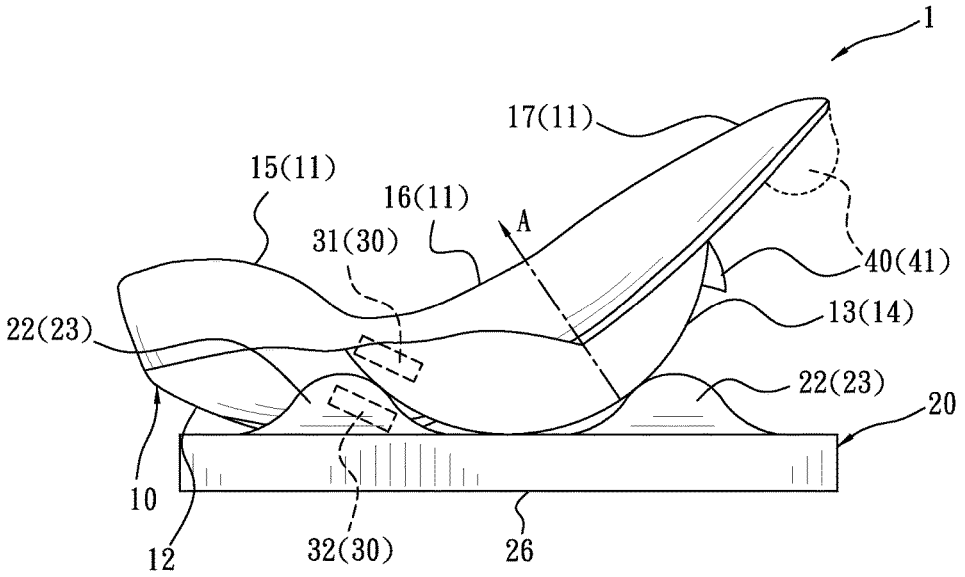
FIG. 15 is a side view of the embodiment shown in FIG. 14 according to the present invention.
Figure 16:
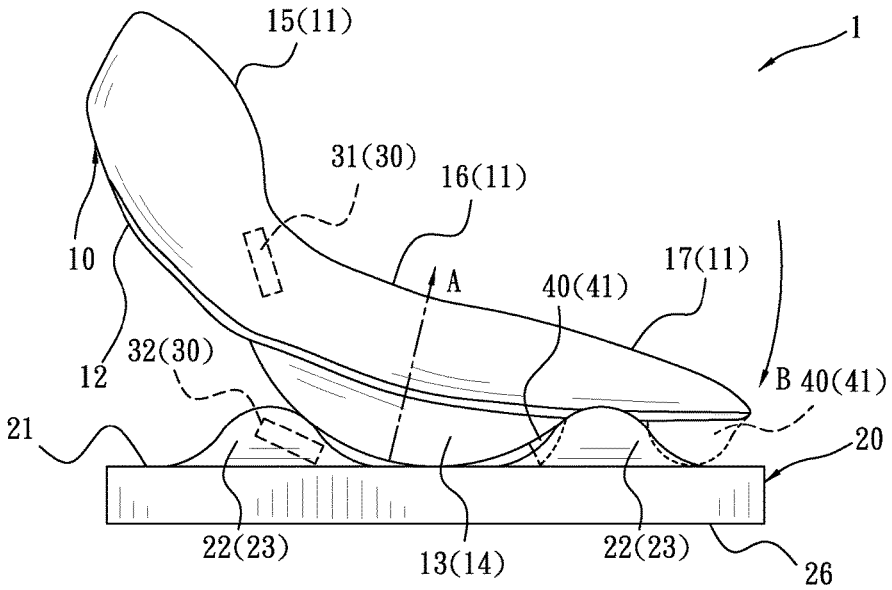
FIG. 16 is a side view of the embodiment shown in FIG. 15 in movement according to the present invention.
Figure 18:
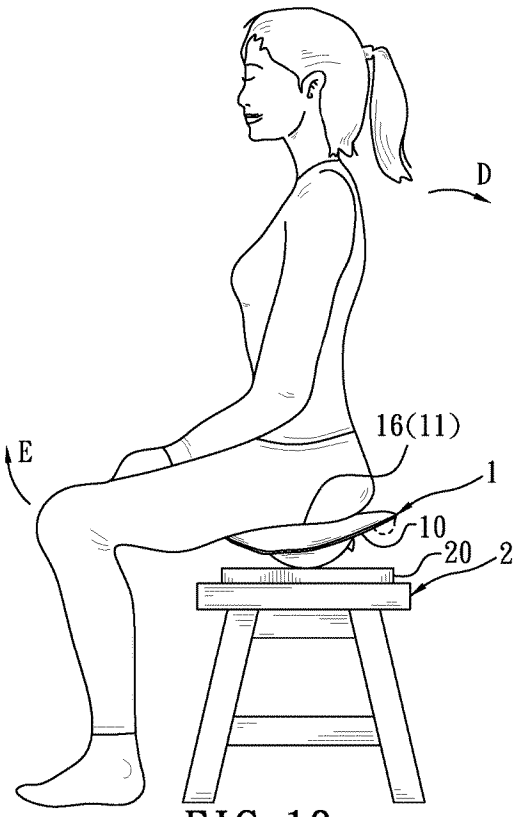
FIG. 18 is a schematic drawing showing a side view of an embodiment being sat by a user according to the present invention.

Refer to FIG. 11 and FIG. 15, the bottom surface of the pommel portion 15 of the seat member 10 is leaning against one of the spherical bumps 23. At least one first magnet 31 is disposed on the bottom surface of the pommel portion 15 while at least one second magnet 32 is set in the spherical bump 23 being leaned against by the bottom surface of the pommel portion 15. By the first magnet 31 and the second magnet 32 magnetically attracted to each other, the pommel portion 15 of the seat member 10 above the spherical bump 23 is inclined forward, attached to and positioned on the spherical bump 23.

Refer to FIG. 6, FIG. 7-9 and FIG. 14-16, the rotatable seat 1 is further provided with a stopping member for preventing falling backwards 40. The stopping member for preventing falling backwards 40 is mounted between the bottom surface of the cantle portion 17 of the seat member 10 and the top surface 21 of the base member 20 and used for stopping the cantle portion 17 and preventing the cantle portion 17 from being inclined continuously after being moved to a preset/critical angle, as shown in FIG. 8, FIG. 9, and FIG. 16. This makes the user less likely to fall backwards while sitting on or using the rotatable seat 1. Moreover, the stopping member for preventing falling backwards 40 includes at least one projecting part 41 with a certain height that is integrally connected to the bottom surface of the seat member 10, as shown in FIG. 6-9 and FIG. 14-16. Or the projecting part 41 can be a part being connected to the bottom surface of the seat member 10 in other ways such as by fasteners. Similarly, the projecting part 41 can also be disposed on the top surface 21 of the base member 20, as shown in FIG. 9.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A rotatable seat for preventing falling backwards comprising:

a seat member having a saddle-shaped surface that is used for allowing users to sit thereon and including a pommel portion, a seat portion and a cantle portion arranged in turn from front to back, and a spherical surface portion projecting from a bottom surface of the saddle-shaped surface;

a base member disposed under the seat member and having at least one support portion on a top surface thereof; and a safety member for preventing users from falling backwards including at least one first magnet and at least one second magnet that are attracted to each other;

wherein the spherical surface portion of the seat member is moveably disposed on the support portion of the base member so that the seat member is able to be moved in different directions or at different angles relative to the base member; wherein the first magnet is set on a front part of the spherical surface portion of the seat member, close to the pommel portion while the second magnet is mounted in the support portion of the base member; wherein users can work out by keeping their bodies balanced or shaking their buttocks, like horseback riding while sitting on the saddle-shaped surface of the seat member; wherein the pommel portion of the seat member is inclined forwards, attached to and positioned on the support portion of the base member, unable to be moved freely due to attraction between the first magnet and the second magnet of the safety member for preventing users from falling backwards when the rotatable seat is not in use; the users' buttocks can cross over the pommel portion easily to sit on the seat member more safely while using the rotatable seat.

2. The device as claimed in claim 1, wherein the spherical surface portion of the seat member is a hemisphere.

3. The device as claimed in claim 1, wherein the support portion on the top surface of the base member is a flat surface.

4. The device as claimed in claim 3, wherein the second magnet is arranged at a center of the flat surface.

5. The device as claimed in claim 1, wherein the support portion of the base member includes three spherical bumps that are projecting from the top surface of the base member, having the same height and arranged at the top surface in a regular triangle manner; thus the spherical surface portion of the seat member is moveably supported by the three spherical bumps.

6. The device as claimed in claim 5, wherein a bottom surface of the pommel portion of the seat member is leaning against one of the spherical bumps.

7. The device as claimed in claim 6, wherein the second magnet is mounted in the spherical bump being leaned against by the bottom surface of the pommel portion.

8. The device as claimed in claim 1, wherein the rotatable seat further includes a stopping member for preventing falling backwards; the stopping member for preventing falling backwards is mounted between a bottom surface of the cantle portion of the seat member and the top surface of the base member to stop and prevent the cantle portion from being inclined continuously after being moved to a certain angle.

9. The device as claimed in claim 8, wherein the stopping member for preventing falling backwards further includes at least one projecting part with a certain height; the projecting part is arranged at a rear part of the spherical surface portion of the seat member, close to the cantle portion, the bottom surface of the cantle portion of the seat member, or a rear part of the top surface of the base member.

* * * * *